US006144935A

United States Patent [19]

Chen et al.

[11] Patent Number: 6,144,935

[45] Date of Patent: Nov. 7, 2000

[54] TUNABLE PERCEPTUAL WEIGHTING FILTER FOR TANDEM CODERS

[75] Inventors: Juin-Hwey Chen, Neshanic Station; Richard Vandervoort Cox, New Providence; Nuggehally Sampath Jayant, Gillette, all of N.J.

[73] Assignee: Lucent Technologies Inc., Murray Hill, N.J.

[21] Appl. No.: 08/901,454

[22] Filed: Jul. 28, 1997

Related U.S. Application Data

[62] Division of application No. 08/762,473, Dec. 9, 1996, Pat. No. 5,694,519, which is a continuation of application No. 08/263,212, Jun. 17, 1994, abandoned, which is a continuation of application No. 07/837,509, Feb. 18, 1992, abandoned.

[51] Int. Cl.[7] ..... G10L 3/00

[52] U.S. Cl. ..... 704/220; 704/223

[58] Field of Search ..... 704/200, 211, 704/203, 219, 221–230; 379/88, 340, 347

[56] References Cited

U.S. PATENT DOCUMENTS

| | | | |
|---|---|---|---|
| 4,617,676 | 10/1986 | Jayant et al. | 375/27 |
| 4,726,037 | 2/1988 | Jayant | 375/27 |
| 4,980,916 | 12/1990 | Zinser | 381/36 |
| 5,054,073 | 10/1991 | Yazu | 381/37 |
| 5,113,448 | 5/1992 | Nomura et al. | 381/47 |
| 5,140,638 | 8/1992 | Moulsley et al. | 381/36 |
| 5,142,583 | 8/1992 | Galand et al. | 381/38 |
| 5,142,584 | 8/1992 | Ozawa | 381/36 |
| 5,187,735 | 2/1993 | Garcia et al. | 379/88 |
| 5,233,660 | 8/1993 | Chen | 381/38 |
| 5,339,384 | 8/1994 | Chen | 395/2.2 |
| 5,694,519 | 12/1997 | Chen et al. | 704/228 |

OTHER PUBLICATIONS

J–H. Chen, "A Robust Low–Delay CELP Speech Coder at 16 Kbit/s," *Proc. GLOBECOM*, 1237–1241 (Nov. 1989).

J–H. Chen, "High–Quality 16 KB/S Speech Coding With A One–Way Delay Less Than 2 MS," *Proc. ICASSP*, 453–456 (Apr. 1990).

J–H. Chen et al., "Real–Time Implementation and Performance of a 16 kb/s Low–Delay CELP Speech Coder," *Proc. ICASSP*, 181–184 (Apr. 1990).

J–H. Chen et al., Real–Time Vector APC Speech Coding at 4800 bps With Adaptive Potfiltering, Proc. IEEE Int. Conf. Acoust., Speech, Signal Processing, 2185–2186 (Apr. 1987).

J–H. Chen et al., "A Fixed–Point 16 kb/s LD–CELP Algorithm," *Proc. ICASSP*, 21–24 (May 1991).

"Draft Recommendation on 16 kbit/s Voice Coding," CCITT Study Group XV, Geneva, Switzerland, Nov. 11–22, 1991.

*Primary Examiner*—David D. Knepper

*Attorney, Agent, or Firm*—Kenneth M. Brown

[57] ABSTRACT

A tunable perceptual weighting filter is used in tandem codecs (coder/decoders). Specific filter parameters are advantageously tuned to provide improved performance in tandeming contexts. The parameters used are 10th order LPC (Linear Predictive Coding) predictor coefficients. The system employed uses Low-Delay Code Excited Linear Predictive codecs (LD-CELP).

19 Claims, 6 Drawing Sheets

TUNABLE PERCEPTUAL WEIGHTING FILTER FOR TANDEM CODERS

This application is a division of application Ser. No. 08/762473 filed on Dec. 9, 1996 by Juin-Hwey Chen, Richard Vandervoort Cox and Nuggehally Sampath Jayant, now U.S. Pat. No. 5,694,519, which is a continuation of application Ser. No. 08/263212 filed on Jun. 17, 1994, now abandoned, which is a continuation of application Ser. No. 07/837509 filed on Feb. 18, 1992, now abandoned.

FIELD OF THE INVENTION

This invention relates to digital communications, and more particularly to digital coding of speech or audio signals with low coding delay and high-fidelity at reduced bit-rates.

RELATED APPLICATIONS

This application is related to subject matter disclosed in U.S. Pat. application Ser. No. 07/298451, by J-H Chen, filed Jan. 17, 1989, now abandoned, and copending U.S. patent application Ser. No. 07/757,168 by J-H Chen, filed Sep. 10, 1991, now U.S. Pat. No. 5,233,660 assigned to the assignee of the present application. Also related to the subject matter of this application is a copending application Ser. No. 07/837,522, filed Feb. 18, 1992 by J-H Chen entitled "Code-Excited Linear Predictive Coding With Low Delay For Speech Or Audio Signals," now abandoned which application is assigned to the assignee of the present application.

BACKGROUND OF THE INVENTION

Introduction

The International Telegraph and Telephone Consultative Committee (CCITT), an international communications standards organization, has been developing a standard for 16 kb/s speech coding and decoding for universal applications. The standardization process included the issuance by the CCITT of a document entitled "Terms of Reference" prepared by the ad hoc group on 16 kbit/s speech coding (Annex 1 to question 21/XV), Jun. 1988. The evaluation of candidate systems seeking to qualify as the standard system has thus far been divided into two phases, referred to as Phase 1 and Phase 2.

Presently, the candidate being consider for the standard is Low-Delay Code Excited Linear Predictive Coding (hereinafter, LD-CELP) described in substantial part in the incorporated application Ser. No. 07/298451. Aspects of this coder are also described in J-H Chen, "A robust low-delay CELP speech coder at 16 kbit/s," Proc. GLOBECOM, pp. 1237–1241 (Nov. 1989); J-H Chen, "High-quality 16 kb/s speech coding with a one-way delay less than 2 ms," Proc. ICASSP, pp. 453–456 (Apr. 1990); J-H Chen, M. J. Melchner, R. V. Cox and D. O. Bowker, "Real-time implementation of a 16 kb/s low-delay CELP speech coder," Proc. ICASSP. pp. 181–184 (Apr. 1990); all of which papers are hereby incorporated herein by reference as if set forth in their entirety. The patent application Ser. No. 07/298,451 and the cited papers incorporated by reference describe aspects of the LD-CELP system as evaluated in Phase 1. Accordingly, the system described in these papers and the application Ser. No. 07/298,451 will be referred to generally as the Phase 1 System.

A document further describing the LD-CELP candidate standard system was presented in a document entitled "Draft Recommendation on 16 kbit/s Voice Coding," submitted to the CCITT Study Group XV in its meeting in Geneva, Switzerland during Nov. 11–22, 1991 (hereinafter, "Draft Recommendation"), which document is incorporated herein by reference in its entirety. For convenience, and subject to deletion as may appear desirable, part or all of the Draft Recommendation is also attached to this application as Appendix 1. The system described in the Draft Recommendation has been evaluated during Phase 2 of the CCITT1 standardization process, and will accordingly be referred to as the Phase 2 System. Other aspects of the Phase 2 System are also described in a document entitled "A fixed-point Architecture for the 16 kb/s LD-CELP Algorithm" (hereinafter, "Architecture Document") submitted by the assignee of the present application to a meeting of Study Group XV of the CCITT held in Geneva, Switzerland on Feb. 18 through Mar. 1, 1991. The Architecture Document is hereby incorporated by reference as if set forth in its entirety herein and a copy of that document is attached to this application for convenience as Appendix 2. Also incorporated by reference as descriptive of the Phase 2 System and J. H. Chen, Y. C. Lin, and R. V. Cox, "A fixed point 16 kb/s LD-CELP Algorithm," Proc. ICASSP, pp. 21–24, (May 1991).

Tandeming

One requirement set by the CCITT involved performance when a series of encodings and decodings of input information occurred in the course of communicating from an originating location to a terminating location. Each of the individual encodings and decodings is associated with a point-to-point communication, while the concatenation of such point-to-point communications is referred to as "tandeming." CCITT specified performance requirements for both point-to-point performance and for three asynchronous tandems, i.e., tandeming of three encodings and decodings.

Tandem encodings of higher bit-rate coders such as 64 kb/s G.711 PCM and 32 kb/s G.721 ADPCM have been studied in detail over the years. The objective signal-to-noise ratio (SNR) of these coders can be predicted by a simple model: the SNR drops 3 dB per doubling of the number of tandems. The assumption of this model is that the coding noise of each coding stage is uncorrelated with the coding noise of other coding stages. Under this assumption, if the number of tandems doubles, the noise power also doubles, and therefore the SNR drops by 3 dB. This model also predicts that improvements in the single encoding SNR of a coder do not change the relative amount that the SNR declines with successive encodings.

In tandeming experiments on the Phase 1 system, it was found that the SNR of 16 kb/s LD-CELP followed the -3 dB per doubling model quite well. Regardless of improvements to the SNR for a single encoding, the SNR always dropped by about 3 dB after 2 asynchronous encodings and by about 4.8 dB after 3 encodings.

The LD-CELP coder in the Phase 1 system (hereinafter, the "Phase 1 coder") had been carefully optimized for a single encoding under the delay and robustness constraints imposed by the CCITT. Thus improvements in the single encoding process SNR by a significant amount (even by only 0.5 dB) proved quite difficult. Although the single encoding speech quality of LD-CELP was quite good, after 3 asynchronous tandems, the coding noise floor increased by about 4.8 dB, resulting in relatively noisy speech. Even with an improvement of the single encoding SNR by 0.5 dB, the improvement would not be tripled after 3 encodings. The noise floor after 3 encodings would only be lowered by 0.5 dB, an insufficient improvement for some purposes.

Thus, in some respects, the so-called "Phase 1" system described in the above- incorporated application Ser. No. 07/298451 and incorporated papers, other than the Draft Recommendation, operated with degraded performance under tandeming conditions.

So-called postfilters have been used in the signal processing arts to improve the perceived quality of received signals. See, for example, U.S. Pat. No. 4,726,037 by N. S. Jayant on Feb. 16, 1988 and U.S. Pat. No. 4,617,676 issued Oct. 14, 1986 to N. S. Jayant and V. Ramamoorthy. Both of these patents are assigned to the assignee of the present application. While postfilters have been useful in some context, it has been the prevailing view that such techniques would not be useful in a Phase 1 System.

SUMMARY OF THE INVENTION

In accordance with aspects of illustrative embodiments of the present invention, a method and corresponding system are provided which effectively avoid impairments or limitations of prior coders and decoders (including Phase 1 systems). These aspects of the present invention provide improved performance, including improved performance for tandeming applications. Further, these improvements are illustratively all achieved within the low delay constraints sought in the CCITT standardization process. These and other advances provided by the present invention are achieved, in an illustrative embodiment, in a speech coder in a low delay code excited linear predictive coding (LD-CELP) system of the type characterized above as the Phase 2 system.

Briefly, in accordance with one aspect of the present invention, the perceptual weighting of the perceptual weighting filter of the Phase 1 System is modified to provide improved weighting. New values for system parameters provide enhanced performance in tandeming contexts. Additionally, a specially selected postfilter is advantageously added at a decoder to achieve improved overall performance.

DETAILED DESCRIPTION

The above-cited Draft Recommendation describes the Phase 2 system in detail and should be referred to for additional information in making and using the present invention. FIGS. 1 through 8 correspond to identically numbered figures in the Draft Recommendation.

Perceptual Weighting Filter

Figure 1A:
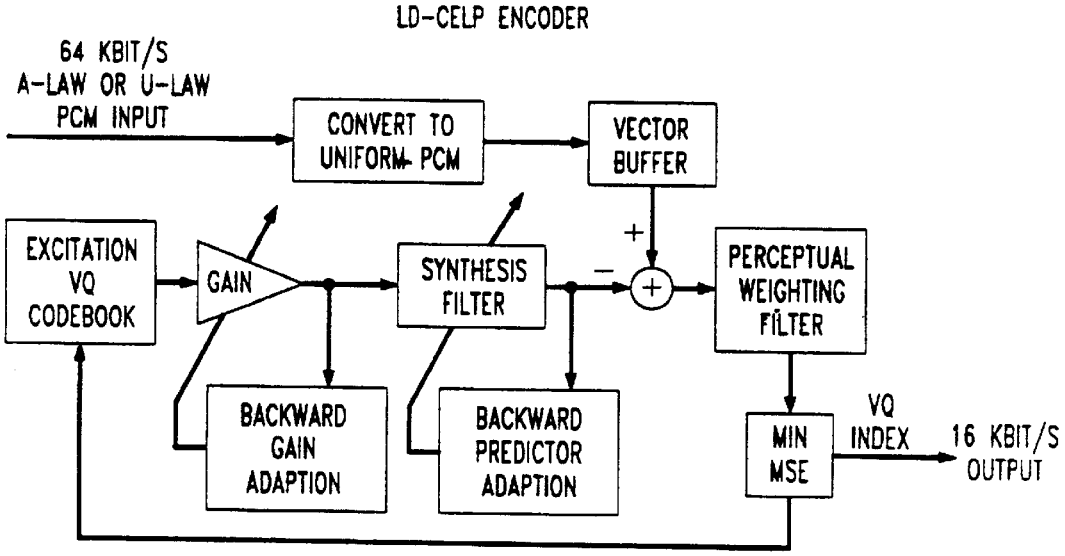
FIG. 1A (PRIOR ART)
FIGS. 1A and 1B are simplified block diagrams of a Phase 2 LD-CELP encoder and decoder, respectively, in accordance with an illustrative embodiment of the present invention.
Figure 1B:
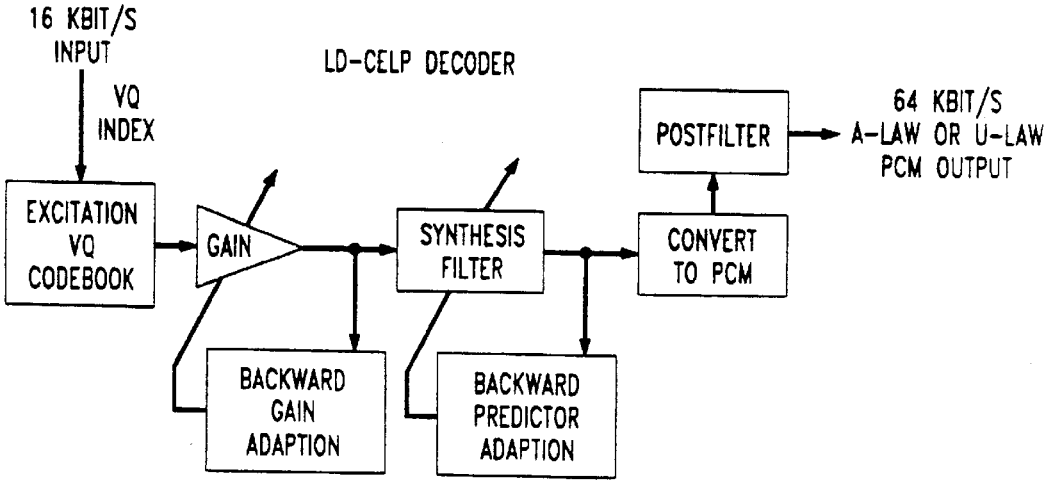
FIG. 1B (PRIOR ART)
Figure 2:
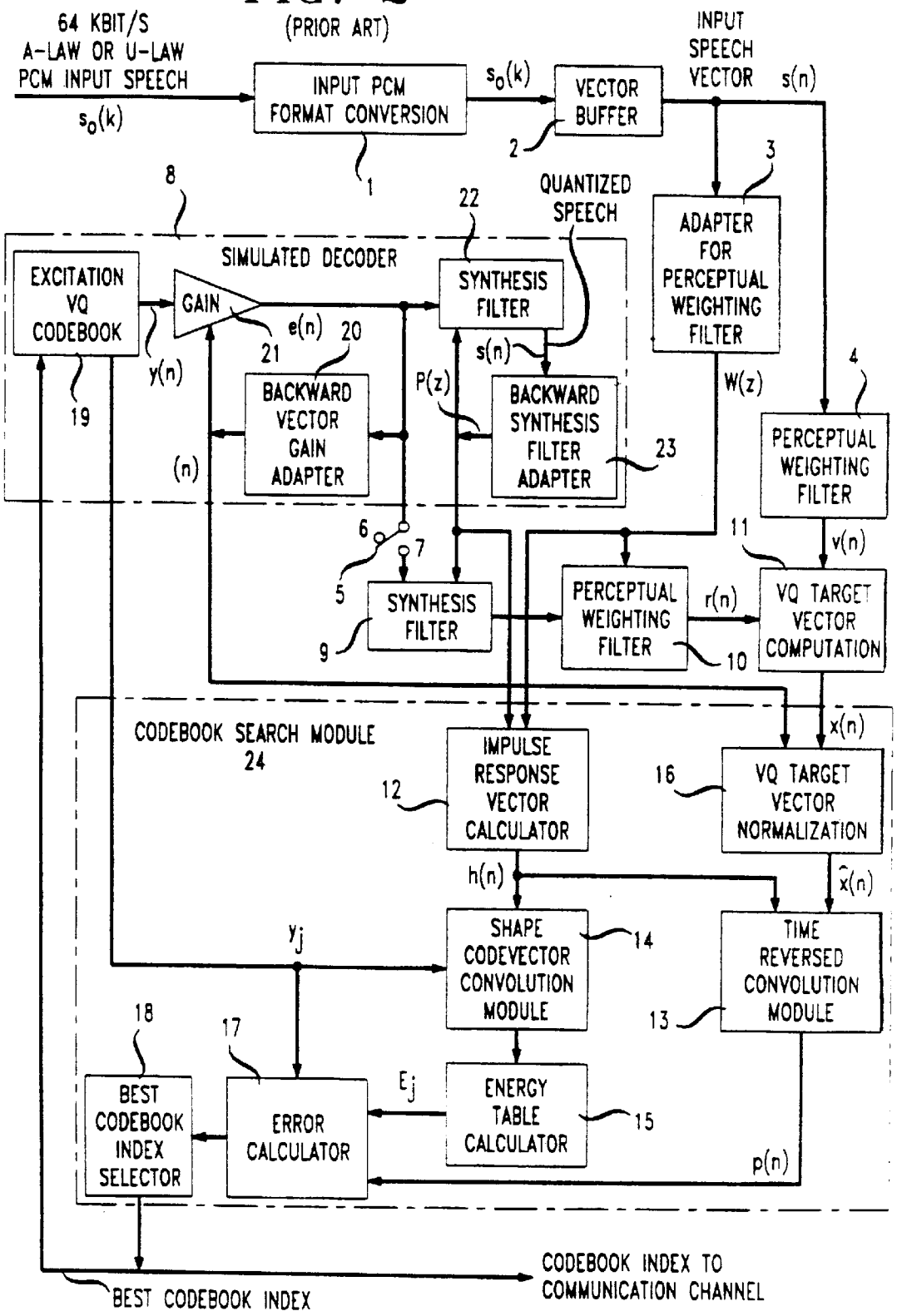
FIG. 2 (PRIOR ART)
FIG. 2 is a schematic block diagram of a Phase 2 L-CELP encoder in accordance with an illustrative embodiment of the present invention.
Figure 3:
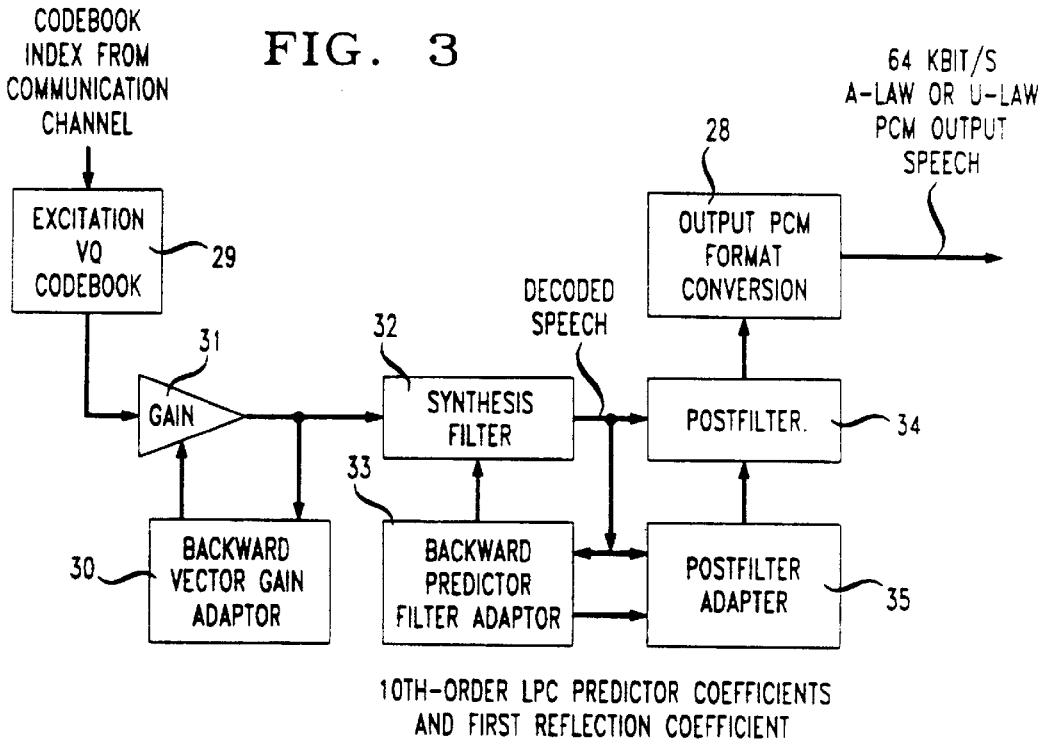
FIG. 3 is a schematic block diagram of a Phase 2 LD-CELP decoder in accordance with an illustrative embodiment of the present invention.
Figure 4A:
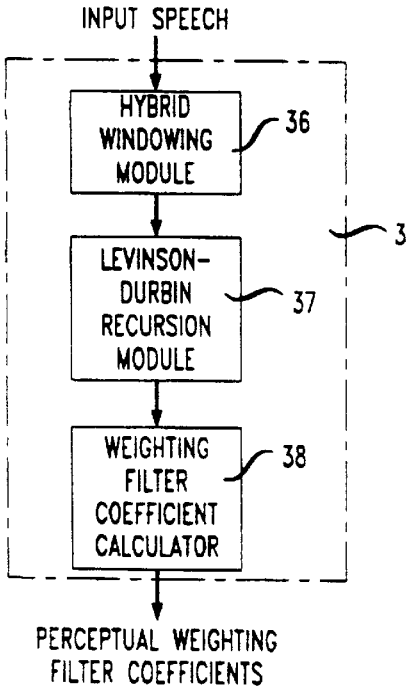
FIG. 4A (PRIOR ART)
FIG. 4A is a schematic block diagram of a perceptual weighting filter adapter for use in a Phase 2 System in accordance with an illustrative embodiment of the present invention.
Figure 5:
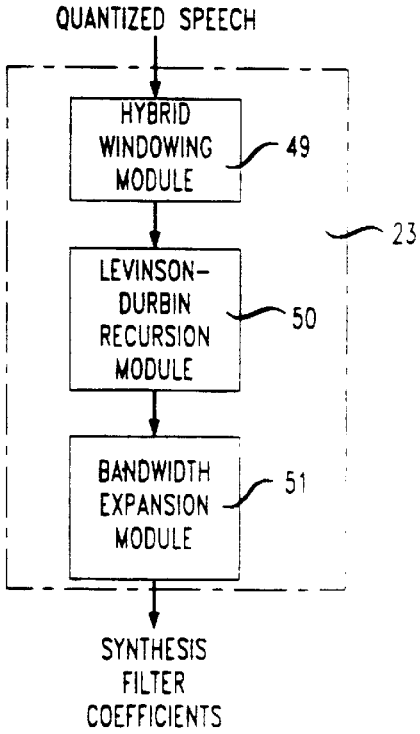
FIG. 5 is a schematic block diagram of a backward synthesis filter adapter for use in a Phase 2 System in accordance with an illustrative embodiment of the present invention.
Figure 4B:
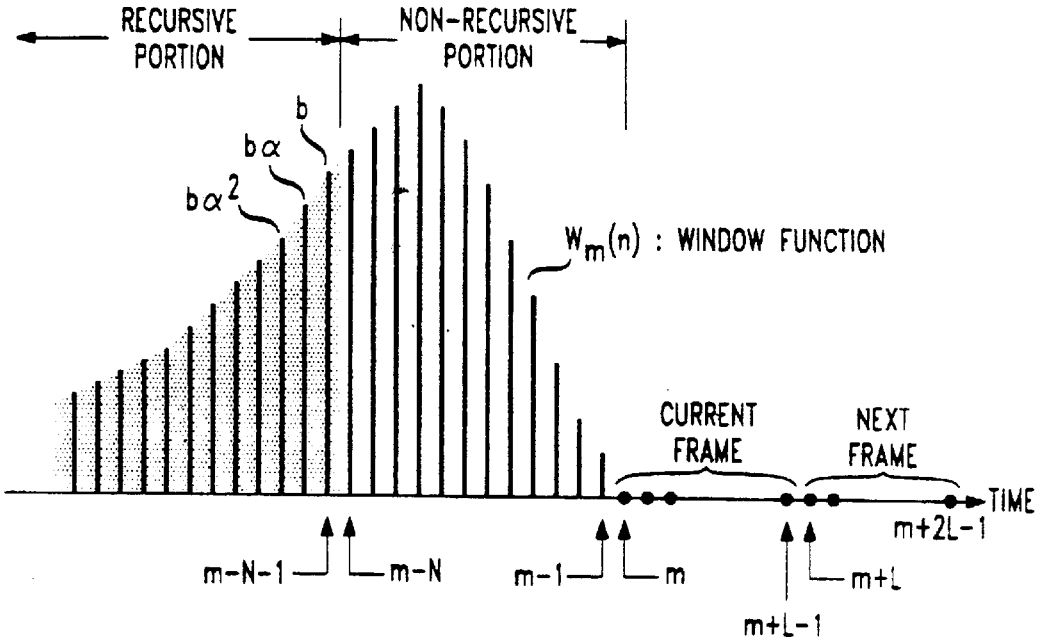
FIG. 4B illustrates a hybrid window used in a Phase 2 System in accordance with an illustrative embodiment of the present invention.
Figure 6:
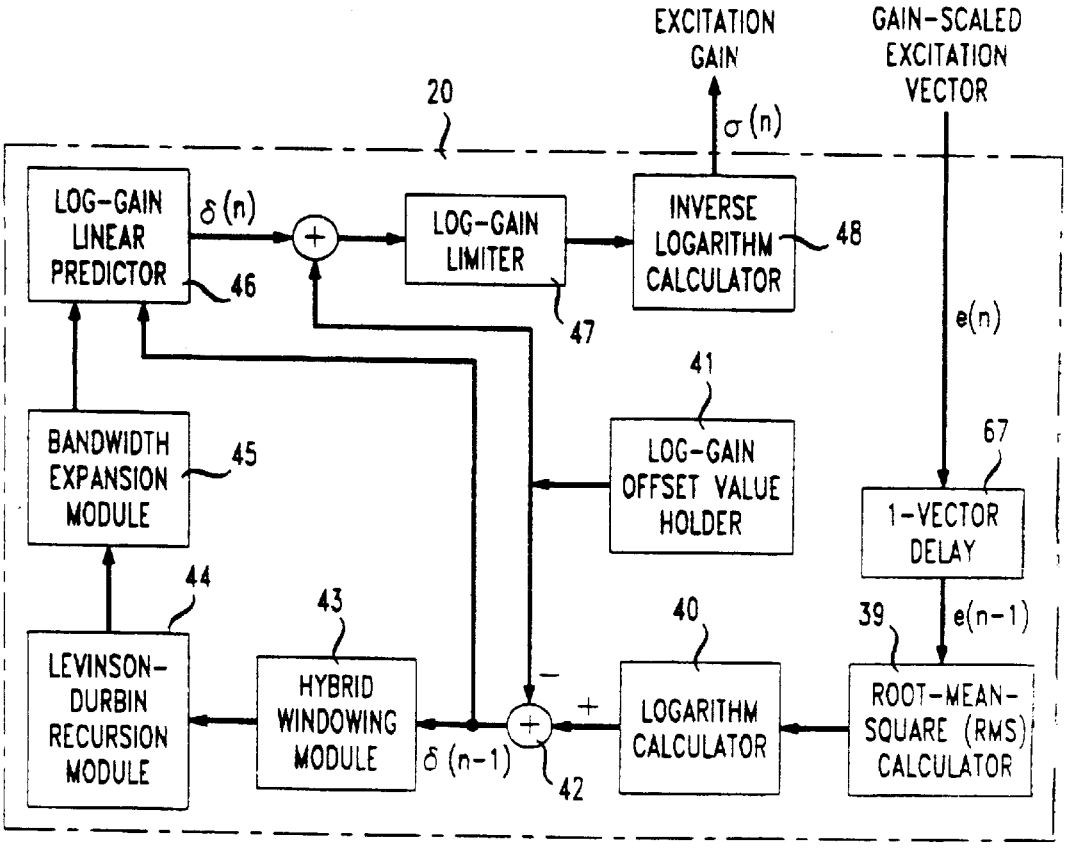
FIG. 6 is a schematic block diagram of a backward vector gain adapter for use in a Phase 2 System in accordance with an illustrative embodiment of the present invention.

The perceptual weighting filter used in the Phase 2 LD-CELP system appears in FIG. 2 as blocks 4 and 10 and has a transfer function of $$W(z) = \frac{\sum_{i=0}^{10} (q_i \alpha^i) z^{-i}}{\sum_{i=0}^{10} (q_i \beta^i) z^{-i}}, \tag{1}$$

where $q_i$'s are the predictor coefficients derived by a 10th-order LPC analysis on the input speech. Adapter 3 in FIG. 2 is used for providing the predictor coefficients in the manner illustrated in FIG. 4A. Each of the elements shown in FIG. 4A is described in detail in the Draft Recommendation of Appendix A to this application.

In the Phase 1 coder, $\alpha$ and $\beta$ were chosen as 0.9 and 0.4 to optimize the speech quality for a single encoding. Using values substantially given by $\alpha$=0.9 and $\beta$=0.6 improves the speech quality for 3 asynchronous encodings, although the single encoding quality might be slightly degraded The single encoding quality is improved, however, by re-optimizing the gain and shape codebooks for the new perceptual weights advantageously using a large multiple-language training database 25 with Intermediate Reference System frequency weighting (CCITT Recommendation P.48).

Adaptive Postfilter

In the Phase 1 coder, a postfilter was not used for two reasons. First, the slight distortion introduced by postfiltering accumulates during tandem coding and results in severely distorted speech. Second, the postfilter inevitably introduces phase distortion, which may cause problems when transmitting modem signals that carry information in their phase.

It has been found, however, that the main reason for severe postfiltering distortion during tandeming is that previous postfilters were tuned for a single encoding. When such postfilters were applied several times in tandem coding, the amount of filtering became excessive, resulting in severely distorted speech. It proves desirable, therefore, to reduce the amount of postfiltering for each coding stage. In other words, the postfilter is advantageously made "milder" by reducing the difference between the spectral peaks and valleys of the postfilter frequency response. Listening tests, indicate the proper values for postfilter parameters after 3 asynchronous encodings.

A remaining issue arising with the use of a postfilter is the potential adverse effects the postfilter might have on modem signals. In accordance with one aspect of the present invention, the postfilter (and the perceptual weighting filter) are deactivated when a modem signal is detected by a modem signal detector. This is similar to the strategy used in G.721 ADPCM, where the quantizer step size adaptation is dynamically locked if a detector detects the presence of a modem signal.

Figure 7:
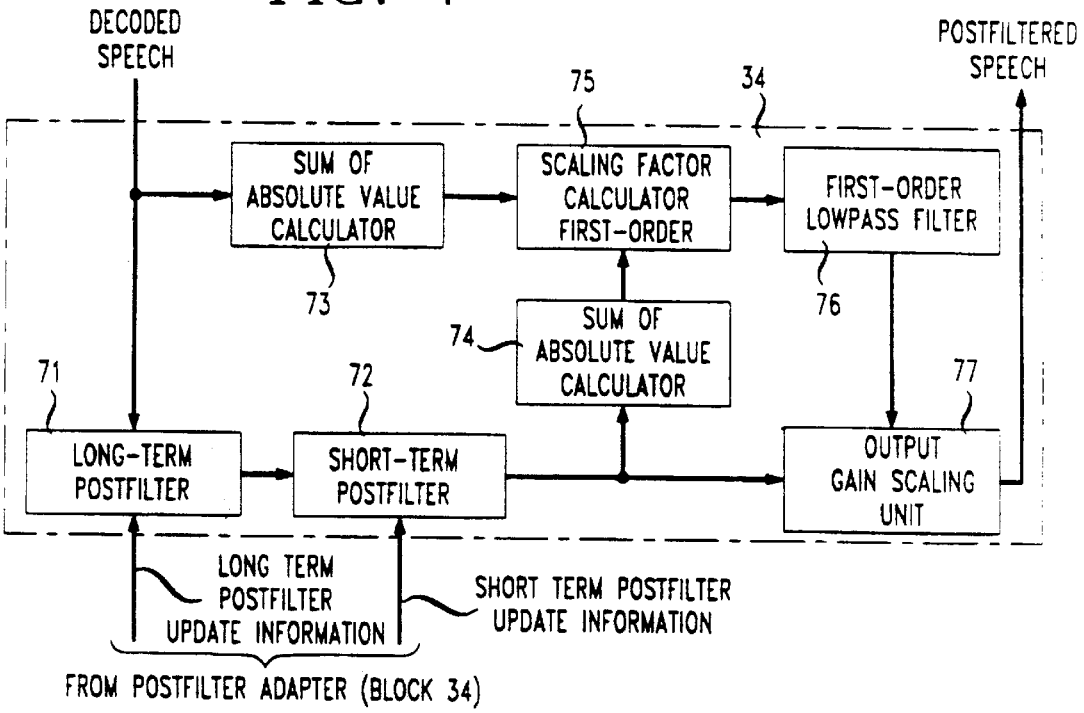
FIG. 7 is a schematic block diagram of a postfilter for use in a Phase 2 System in accordance with an illustrative embodiment of the present invention.
Figure 8:
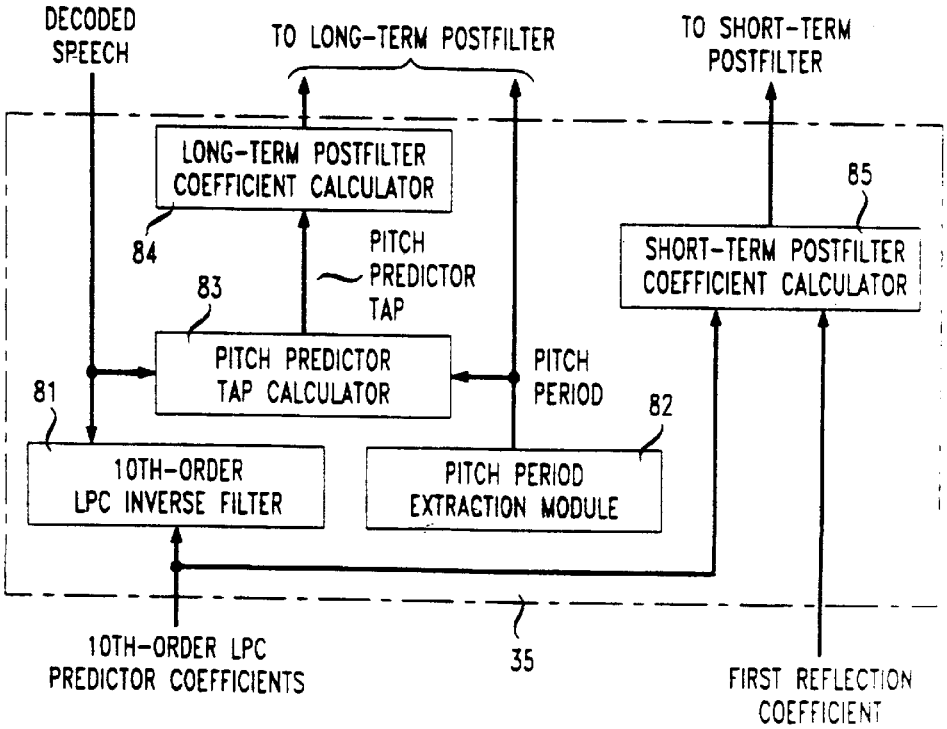
FIG. 8 is a schematic block diagram of a postfilter adapter for use in a Phase 2 System in accordance with an illustrative embodiment of the present invention.
Figure 9:
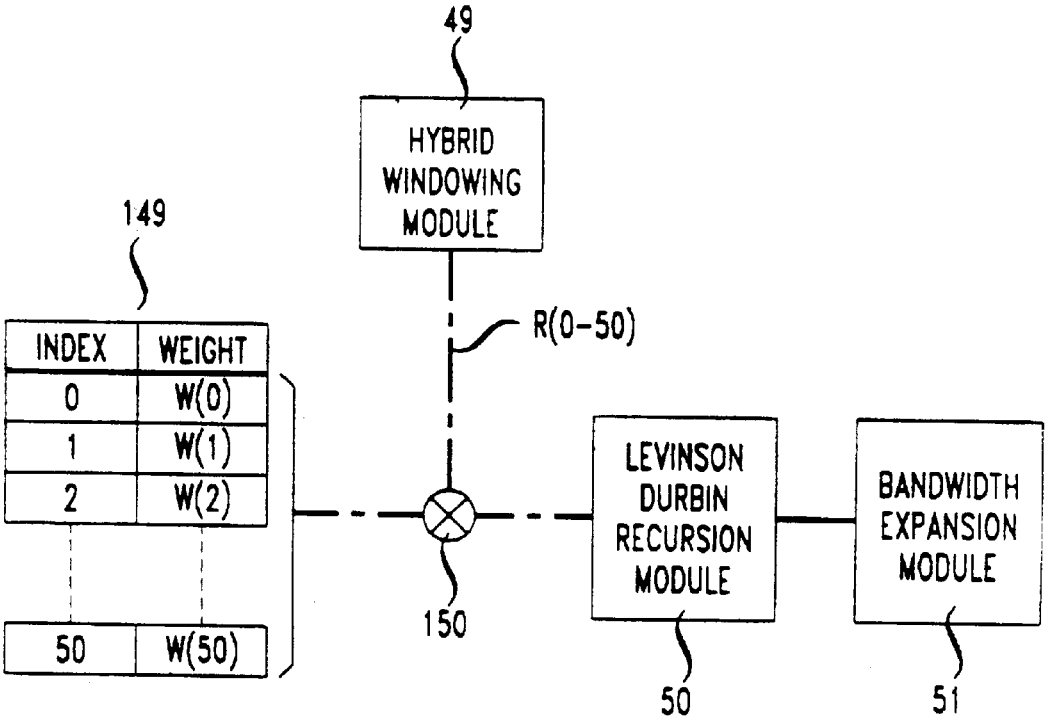
FIG. 9 is a schematic block diagram showing a more detailed view of the illustrative backward synthesis filter of FIG. 5.

The adaptive postfilter used in the Phase 2 LD-CELP coder is based on the postfilter proposed in J.-H. Chen, "Low-bit-rate predictive coding of speech waveforms based on vector quantization," PhD. Dissertation, Univ. of California, Santa Barbara, March 1987; and J.-H. Chen and A. Gersho, "Real-time vector APC speech coding at 4800 bps with adaptive postfiltering," Proc. IEEE Int. Conf. Acoust., Speech, Signal Processing, pp.2185–2188, April 1987. A schematic block diagram of this postfilter is shown in FIG. 7.

The long-term postfilter has a transfer function of $$H_l(z)=g_l(1+b\,z^{-p}), \tag{2}$$

where p is the pitch period of decoded speech (in samples), b is the filter coefficient. and $g_l$ is a scaling factor. Although LD-CELP does not use a pitch predictor, the pitch period is conveniently extracted from the decoded speech using a pitch extractor. To determine b and $g_l$, we first calculate β, the optimal tap weight of a single-tap pitch predictor with a pitch period of p samples. Then, b and $g_l$ are given by $$b=\begin{cases}0 & \text{if } \beta<0.6\\ \lambda\beta & \text{if } 0.6\le\beta\le 1\\ \lambda & \text{if } \beta>1\end{cases} \tag{3}$$

$$g_l=\frac{1}{1+b}, \tag{4}$$

where λ is a tunable parameter which controls the amount of long-term postfiltering.

The short-term postfilter has a transfer function of $$H_s(z)=\frac{1-\sum_{i=1}^{10}\bar{b}_i z^{-i}}{1-\sum_{i=1}^{10}\bar{a}_i z^{-i}}\,[1+\mu z^{-1}] \tag{5}$$

where $$\bar{b}_i=\tilde{a}_i\gamma_1^{\,i},\ i=1,2,\ldots,10, \tag{6}$$

$$\bar{a}_i=\tilde{a}_i\gamma_2^{\,i},\ i=1,2,\ldots,10, \tag{7}$$

$$\mu=\gamma_3 k_1\,. \tag{8}$$

The tunable parameters $\gamma_1$, $\gamma_2$, and $\gamma_3$ control the amount of short-term postfiltering. In Eqs. (6) through (8), $\tilde{a}_i$'s are the predictor coefficients obtained by a 10th-order backward-adaptive LPC analysis on the decoded speech, and $k_1$ is the first reflection coefficient obtained by the same LPC analysis. Note that both $\tilde{a}_i$'s and $k_1$ can be obtained as by-products of the 50th-order backward-adaptive LPC analysis regularly performed at the LD-CELP decoder (by temporarily stopping the recursion at order 10). See the Draft Recommendation for more details regarding the operation of the 50th-order backward-adaptive LPC analysis. After some tuning, it was found that the combination of λ=0.15, $\gamma_i$=0.65, $\gamma_2$=0.75, and $\gamma_3$=0.15 drastically improved the triple encoding speech quality without introducing noticeable postfiltering distortion.

While the above illustrative embodiment of the present invention was described in the context of the Phase 2 LD-CELP System, it will be clear to those skilled in the art that the principles of perceptual weighting and postfiltering described will have applicability in connection with other coding and transmission methods and systems.

We claim:

1. A method of processing one sequence of a plurality of sequences of input samples to generate a processed signal, the method comprising weighting the one sequence in a perceptual weighting filter, the perceptual weighting filter having a set of tunable parameters, the set of tunable parameters having preselected values that are based upon an output signal that has been encoded more than once and decoded more than once.

2. The method of claim 1 wherein the plurality of sequences of input samples is comprised of the one sequence and a set of additional sequences of input samples, the method further comprising weighting the set of additional sequences of input samples in the perceptual weighting filter.

3. The method of claim 1 further comprising:

(a) determining, from a set of codewords, sequence of codeword indices, each index determined based upon a respective one of the sequences of input samples; and (b) outputting the sequence of codeword indices.

4. The method of claim 1 wherein the perceptual weighting filter is given by:

$$W(z)=\frac{\sum_{i=0}^{10}(q_i\alpha^i)z^{-i}}{\sum_{i=0}^{10}(q_i\beta^i)z^{-i}}$$

where $q_i$ represents a predictor coefficient derived by a linear predictive coding analysis performed on at least one sequence of input samples previous to said one sequence, each $z^{-i}$ represents a delay of i samples, and α and β are ones of said tunable parameters of the perceptual weighting filter.

5. The method of claim 4 wherein α is about 0.9 and β is about 0.6.

6. An apparatus for processing one sequence of a plurality of sequences of input samples to generate a processed signal, the device comprising a perceptual weighting filter for weighting the one sequence, the perceptual weighting filter having a set of tunable parameters, the set of tunable parameters having preselected values that are based upon an output signal that has been encoded more than once and decoded more than once.

7. The apparatus of claim 6 wherein the device is a code excited linear predictive coder.

8. The apparatus of claim 6 further comprising:

means for determining a sequence of codeword indices, each index determined based upon a respective one of the sequences of input samples; and means for outputting the sequence of codeword indices.

9. The apparatus of claim 6 wherein the perceptual weighing filter is given by:

$$W(z)=\frac{\sum_{i=0}^{10}(q_i\alpha^i)z^{-i}}{\sum_{i=0}^{10}(q_i\beta^i)z^{-i}}$$

where $q_i$ represents a predictor coefficient derived by a linear predictive coding analysis performed on at least one previous sequence of input samples previous to said one sequence, each $z^{-i}$ represents a delay of i samples, and α and β are ones of said tunable parameters of the perceptual weighting filter.

10. The apparatus of claim 4 wherein α is about 0.9 and β is about 0.6.

11. A method of processing at least one sequence of input samples to generate a processed signal, the method comprising weighting the one sequence of input samples in a perceptual weighting filter, the perceptual weighting filter having a set of parameters having values that are based upon an output signal that has been encoded more than once and decoded more than once.

12. The method of claim 11 wherein the perceptual weighting filter is given by:

$$W(z) = \frac{\sum_{i=0}^{10} (q_i \alpha^i) z^{-i}}{\sum_{i=0}^{10} (q_i \beta^i) z^{-i}}$$

where $q_i$ represents a predictor coefficient derived by a linear predictive coding analysis performed on at least one sequence of input samples previous to said one sequence, each $z^{-i}$ represents a delay of i samples, and α and β are ones of said parameters of the perceptual weighting filter.

13. The method of claim 12 wherein α is about 0.9 and β is about 0.6.

14. An apparatus for processing at least one sequence of input samples to generate a processed signal, the apparatus comprising a perceptual weighting filter for weighting the one sequence of input samples, the perceptual weighting filter having a set of parameters having values that are based upon an output signal that has been encoded more than once and decoded more than once.

15. The apparatus of claim 14 wherein the perceptual weighing filter is given by:

$$W(z) = \frac{\sum_{i=0}^{10} (q_i \alpha^i) z^{-i}}{\sum_{i=0}^{10} (q_i \beta^i) z^{-i}}$$

where $q_i$ represents a predictor coefficient derived by a linear predictive coding analysis performed on at least one sequence of input samples previous to said one sequence, each $z^{-i}$ represents a delay of i samples, and α and β are ones of said parameters of the perceptual weighting filter.

16. The apparatus of claim 15 wherein α is about 0.9 and β is about 0.6.

17. A method of processing sequences of input samples to generate a processed signal, the method comprising weighting at least one sequence of input samples in a perceptual weighting filter, wherein the perceptual weighting filter is given by:

$$W(z) = \frac{\sum_{i=0}^{10} (q_i \alpha^i) z^{-i}}{\sum_{i=0}^{10} (q_i \beta^i) z^{-i}}$$

where $q_i$ represents a predictor coefficient derived by a linear predictive coding analysis performed on one or more sequences of input samples previous to said one sequence, each $z^{-i}$ represents a delay of i samples, and α and β are parameters of the perceptual weighting filter, wherein α is about 0.9 and β is about 0.6.

18. An apparatus for processing sequences of input samples to generate a processed signal, the apparatus comprising a perceptual weighting filter applied to at least one sequence of input samples, wherein the perceptual weighting filter is given by:

$$W(z) = \frac{\sum_{i=0}^{10} (q_i \alpha^i) z^{-i}}{\sum_{i=0}^{10} (q_i \beta^i) z^{-i}}$$

where $q_i$ represents a predictor coefficient derived by a linear predictive coding analysis performed on one or more sequences of input samples previous to said one sequence, each $z^{-i}$ represents a delay of i samples, and α and β are parameters of the perceptual weighting filter, wherein α is about 0.9 and β is about 0.6.

19. A perceptual weighting filter for application to at least one sequence of input samples, wherein the perceptual weighting filter is given by:

$$W(z) = \frac{\sum_{i=0}^{10} (q_i \alpha^i) z^{-i}}{\sum_{i=0}^{10} (q_i \beta^i) z^{-i}}$$

where $q_i$ represents a predictor coefficient derived by a linear predictive coding analysis performed on one or more sequences of input samples previous to said one sequence, each $z^{-i}$ represents a delay of i samples, and α and β are parameters of the perceptual weighting filter, wherein α is about 0.9 and β is about 0.6.

* * * * *